US011040732B2

(12) United States Patent
Asuka et al.

(10) Patent No.: US 11,040,732 B2
(45) **Date of Patent: *Jun. 22, 2021**

(54) WIRELESS TRAIN CONTROL SYSTEM, GROUND CONTROL DEVICE, AND WIRELESS TRAIN CONTROL METHOD

(71) Applicant: MITSUBISHI ELECTRIC CORPORATION, Tokyo (JP)

(72) Inventors: Masashi Asuka, Tokyo (JP); Atsushi Takami, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 179 days.

This patent is subject to a terminal disclaimer.

(21) Appl. No.: 16/078,457

(22) PCT Filed: Mar. 9, 2016

(86) PCT No.: PCT/JP2016/057472

§ 371 (c)(1),
(2) Date: Aug. 21, 2018

(87) PCT Pub. No.: WO2017/154157

PCT Pub. Date: Sep. 14, 2017

(65) Prior Publication Data

US 2019/0047599 A1 Feb. 14, 2019

(51) Int. Cl.

| | |
|---|---|
| ***B61L 3/12*** | (2006.01) |
| ***B61L 23/16*** | (2006.01) |
| ***B61L 25/02*** | (2006.01) |
| ***B61L 27/00*** | (2006.01) |

(52) U.S. Cl.

CPC ..... *B61L 3/127* (2013.01); *B61L 23/16* (2013.01); *B61L 25/025* (2013.01);
(Continued)

(58) Field of Classification Search

CPC .... B61L 3/127; B61L 25/025; B61L 27/0038; B61L 27/0077; B61L 27/0061; B61L 23/16; B61L 2027/005

See application file for complete search history.

(56) References Cited

U.S. PATENT DOCUMENTS

| | | | |
|---|---|---|---|
| 8,655,520 B2 | 2/2014 | Tokumaru | |
| 9,434,397 B2 * | 9/2016 | Chung | B61L 15/0027 |

(Continued)

FOREIGN PATENT DOCUMENTS

| | | |
|---|---|---|
| EP | 3363710 A1 | 8/2018 |
| JP | 2014-088098 A | 5/2014 |

(Continued)

OTHER PUBLICATIONS

International Search Report (PCT/ISA/210) dated Apr. 12, 2016, by the Japanese Patent Office as the International Searching Authority for International Application No. PCT/JP2016/057472.

(Continued)

*Primary Examiner* — Donald J Wallace
*Assistant Examiner* — Daniel M. Robert
(74) *Attorney, Agent, or Firm* — Buchanan Ingersoll & Rooney PC

(57) ABSTRACT

A wireless train control system includes: a device that generates a track circuit state signal indicating whether a track circuit is picked up or dropped and a time-triggered track circuit state signal indicating a drop at a timing delayed by a set time after the track circuit state signal indicates that the track circuit is dropped; and a controller that generates a stop limit point of a wireless-control-compliant train by using presence information if a preceding train is a wireless-control-compliant train, and generates the stop limit point by using the track circuit state signal and the time-triggered track circuit state signal if the preceding train is a non- (Continued)

wireless-control-compliant train. The controller does not update the stop limit point if the track circuit state signal indicates that the track circuit is dropped while the time-triggered track circuit state signal indicates that the track circuit is picked up.

11 Claims, 10 Drawing Sheets

(52) U.S. Cl.
CPC ..... *B61L 27/0038* (2013.01); *B61L 27/0061* (2013.01); *B61L 27/0077* (2013.01); *B61L 2027/005* (2013.01)

(56) References Cited

U.S. PATENT DOCUMENTS

| | | | | |
|---|---|---|---|---|
| 10,392,039 | B2 * | 8/2019 | Asuka | B61L 25/06 |
| 2014/0180509 | A1 * | 6/2014 | Goldman | B61L 27/0072 701/19 |

FOREIGN PATENT DOCUMENTS

| | | | | |
|---|---|---|---|---|
| JP | 2014083901 | A | | 5/2014 |
| JP | 2014088098 | A | * | 5/2014 |
| WO | 2011021544 | A1 | | 2/2011 |

OTHER PUBLICATIONS

Extended European Search Report dated Mar. 15, 2019, issued by the European Patent Office in corresponding European Application No. 16893487.5. (9 pages).
Office Action (Communication pursuant to Article 94(3) EPC) dated Feb. 11, 2021, by the European Patent Office in corresponding European Patent Application No. 16893487.5. (7 pages).
Examination Report dated Apr. 20, 2021, issued by the Indian Patent Office in corresponding Application No. 201847030819 and Partial English Translation. (6 pages).

* cited by examiner

WIRELESS TRAIN CONTROL SYSTEM, GROUND CONTROL DEVICE, AND WIRELESS TRAIN CONTROL METHOD

FIELD

The present invention relates to a wireless train control system, a ground control device, and a wireless train control method for controlling a wireless-control-compliant train on a track in Which a wireless-control-compliant train and a non-wireless-control-compliant train coexist.

BACKGROUND

In a wireless train control system called communication-based train control (CBTC), train operation is controlled through communication between a wireless-control-compliant train and a ground control device. In such a wireless train control system, a point spaced a margin distance from the rearmost position of the preceding train is set as a stop limit point of the wireless-control-compliant train. However, when a wireless-control-compliant train and a non-wireless-control-compliant train coexist in the same track, the ground control device cannot identify the rearmost position of the preceding train that is the non-wireless-control-compliant train. It is therefore difficult for the conventional wireless train control system to operate a wireless-control-compliant train and a non-wireless-control-compliant train that coexist in the same track.

Patent Literature 1, which is a conventional technique, aims to achieve a wireless train control system in which a wireless-control-compliant train and a non-wireless-control-compliant train coexist, and discloses the technique of "an automatic train control device including a ground control device 10 that computes a target stop position 22 of a train, and in-vehicle control devices 1*a* and 1*b* that receive the target stop position 22 transmitted from the ground control device 10 and compute speed control patterns 31 and 32 to control the speed of the trains." Specifically, "on a route, a radio-equipped train 6 that wirelessly transmits train ID-train position 21 to the ground control device 10 and a radio-unequipped train 7 coexist." More specifically, "the ground control device 10 manages on-rail information 15 acquired from each track circuit, the train ID-train position 21, a train ID, and a train type in association with each other, calculates stop track circuit information 23, and calculates the target stop position 22 for the radio-equipped train 6."

CITATION LIST

Patent Literature

Patent Literature 1: PCT Patent Application Laid-open No. 2011/021544

SUMMARY

Technical Problem

However, in the above conventional technique, a transmission delay in the wireless train control system is not considered. This causes the following problem: the current position of a train is erroneously identified, which may hinder the stable operation of the wireless train control system.

The present invention has been made in view of the above, and an object thereof is to obtain a wireless train control system capable of stable operation.

Solution to Problem

In order to solve the above-mentioned problem and achieve the object, the present invention provides a wireless train control system to control, by a track circuit state information acquisition device and a ground control device, a wireless-control-compliant train on a track in which one or more wireless-control-compliant trains and one or more non-wireless-control-compliant trains coexist, the wireless train control system comprising: the track circuit states information acquisition device to generate a track circuit state signal and a time-triggered track circuit state signal, the track circuit state signal indicating whether a track circuit of the track is picked up or dropped, the time-triggered track circuit state signal indicating a drop of the track circuit at a timing delayed by a set time after the track circuit state signal indicates that the track circuit is dropped; and the ground control device to generates a stop limit point of the wireless-control-compliant train by using presence information if a preceding train for the wireless-control-compliant train is another wireless-control-compliant train, and generate the stop limit point of the wireless-control-compliant train by using the track circuit state signal and the time-triggered track circuit state signal if the preceding train for the wireless-control-compliant train is the non-wireless-control-compliant train, wherein the ground control device does not update the stop limit point if the track circuit state signal indicates that the track circuit is dropped while the time-triggered track circuit state signal indicates that the track circuit is picked up.

Advantageous Effects of Invention

The present invention can achieve the effect of obtaining a wireless train control system capable of stable operation.

DESCRIPTION OF EMBODIMENT

Hereinafter, a wireless train control system, a ground control device, and a wireless train control method according to an embodiment of the present invention will be described in detail based on the drawings. The present invention is not limited to the embodiment.

Embodiment

Figure 1:
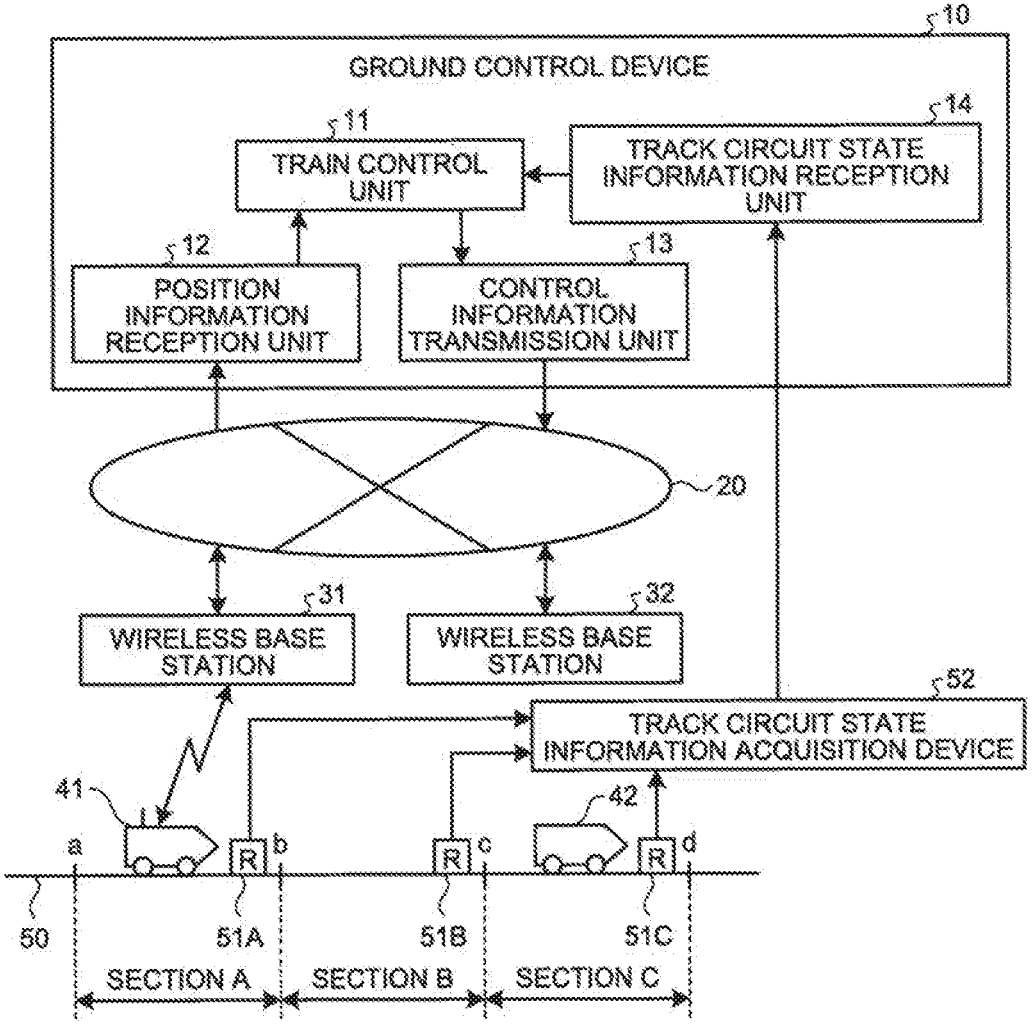
FIG. 1 is a diagram illustrating an exemplary configuration of a wireless train control system according to an embodiment.

FIG. 1 is a diagram illustrating an exemplary configuration of a wireless train control system according to an embodiment of the present invention. The wireless train control system illustrated in FIG. 1 includes a ground control device 10, a network 20, and wireless base stations 31 and 32, and controls a wireless-control-compliant train 41. The wireless-control-compliant train 41 and a non-wireless-control-compliant train 42 travel on a track 50. The non-wireless-control-compliant train 42 is a preceding train for the wireless-control-compliant train 41. The track 50 is divided into a section A between a point "a" and a point "b", a section B between the point "b" and a point "c", and a section C between the point "c" and a point "d". A relay 51A is disposed in the section A, a relay 51B is disposed in the section B, and a relay 51C is disposed in the section C. A track circuit state information acquisition device 52 acquires track circuit state information indicating whether the relays 51A, 51B, and 51C are energized ("picked up", or the track circuit is "picked up") or de-energized ("dropped", or the track circuit is "dropped"), and transmits the acquired track circuit state information to the ground control device 10. In FIG. 1, the wireless-control-compliant train 41 is present in the section A, and the non-wireless-control-compliant train 42 is present in the section C. It should be noted that the wireless-control-compliant train 41 is a train whose operation is controlled by the ground control device 10 that conforms to the wireless train control system, and the non-wireless-control-compliant train 42 is a train that does not conform to the wireless train control system. In each of the sections A, B, and C, one track circuit is provided.

The ground control device 10 includes a train control unit 11, a position information reception unit 12, a control information transmission unit 13, and a track circuit state information reception unit 14. The position information reception unit 12 receives the position information on the wireless-control-compliant train 41 from the wireless base stations 31 and 32 via the network 20, and outputs the position information to the train control unit 11. Note that the position information on the wireless-control-compliant train 41 indicates each of the head position and rearmost position of the wireless-control-compliant train 41 by a block number of the corresponding one of the divisions of the track 50 and by a position within this block. The track circuit state information reception unit 14 receives the track circuit state information of the track 50, and outputs the track circuit state information to the train control unit 11. The train control unit 11 generates control information for the wireless-control-compliant train 41 using the position information on the wireless-control-compliant train 41 output by the position information reception unit 12 and the track circuit state information of the wireless control-compliant train 41 output by the track circuit state information reception unit 14, and outputs the control information to the control information transmission unit 13. The control information transmission unit 13 transmits the control information for the wireless-control-compliant train 41 output by the train control unit 11 from the wireless base stations 31 and 32 to the wireless-control-compliant train 41 via the network 20.

In this manner, although the ground control device 10 can acquire the position information on the wireless-control-compliant train 41 via the network 20 and the wireless base station 31, the ground control device 10 cannot acquire the position information on the non-wireless-control-compliant train 42 through wireless communication. Therefore, the ground control device 10 generates a stop limit point derived from the track circuit based on the non-wireless-control-compliant train 42 by using the track circuit of the track 50 without depending on wireless communication. That is, since the track circuit of the section C is dropped due to the presence of the non-wireless-control-compliant train 42, a stop limit point derived from the track circuit is generated or updated using the point "c", which is the boundary of the section C on the side of the wireless-control-compliant train 41, as a base point. Note that a stop limit point is indicated by a block number of each of the divisions of the track 50 and by a distance from the boundary within the block represented by this block number. At this time, the fact that the stop limit point is based on the track circuit is stored together with the stop limit point.

Figure 2:
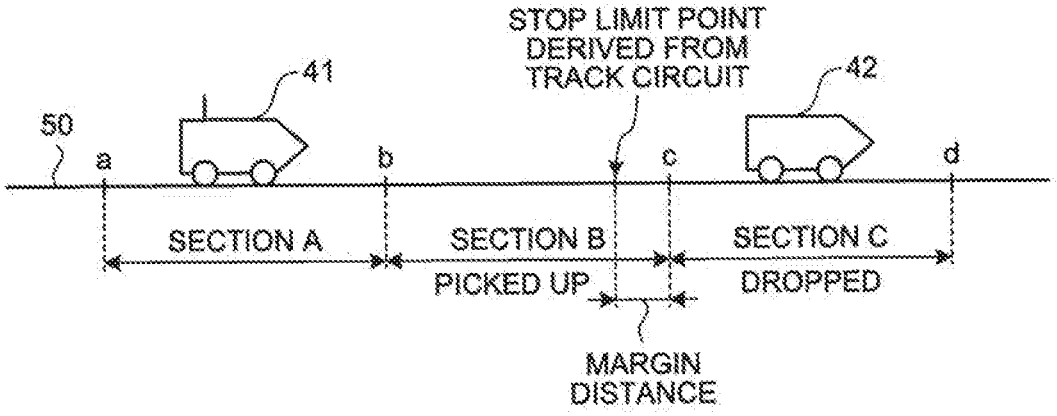
FIG. 2 is a diagram illustrating a stop limit point of a wireless-control-compliant train in the wireless train control system according to the embodiment.

FIG. 2 is a diagram illustrating a stop limit point of the wireless-control-compliant train 41 in the wireless train control system according to the present embodiment. In FIG. 2, the preceding train for the wireless-control-compliant train 41 is the non-wireless-control-compliant train 42. The track circuit in the section C is dropped by the non-wireless-control-compliant train 42, and the track circuit in the section B is picked up. The ground control device 10 uses the track circuit of the track 50 and the position information obtained through wireless communication to identify the presence of the non-wireless-control-compliant train 42 in the section C. A stop limit point derived from the track circuit is set for the wireless-control-compliant train 41. This stop limit point of the wireless-control-compliant train 41 is a position spaced a margin distance from the point "c" which is the boundary between the picked-up section B and the dropped section C. That is, the stop limit point of the wireless-control-compliant train 41 exists in the section B, and the wireless-control-compliant train 41 can travel up to the stop limit point within the section B.

However, a transmission delay occurs in the wireless train control system illustrated in FIG. 1. More specifically, a transmission delay occurs in any of the transmissions between the ground control device 10 and the network 20, between the network 20 and the wireless base stations 31 and 32, and between the wireless base stations 31 and 32 and the wireless-control-compliant train 41. The occurrence of such a transmission delay causes a discrepancy between the present position of the wireless-control-compliant train 41 recognized by the ground control device 10 and the actual present position of the wireless-control-compliant train 41. Not that such a transmission delay time depends on the specifications of the wireless train control system, and is estimated to be about three seconds.

Figure 3:
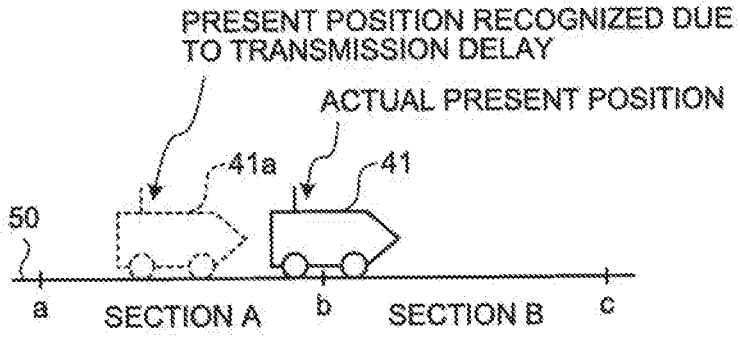
FIG. 3 is a diagram illustrating the actual present position and recognized present position of the wireless-control-compliant train according to the embodiment.

FIG. 3 is a diagram illustrating the actual present position and recognized present position of the wireless-control-compliant train 41 according to the present embodiment. The wireless-control-compliant train 41 in FIG. 3 has just entered the section B across the point "b". However, due to the transmission delay in the wireless train control system, the ground control device 10 recognizes that the wireless-control-compliant train 41 is located where a wireless-control-compliant train 41*a* was located before entering the section B. Although the track circuit has been dropped due to the entry of the wireless-control-compliant train 41 into the section B, the ground control device 10 determines that a non-wireless-control-compliant train is present because there is no position information corresponding to the section B. As a result, the ground control device 10 generates a stop limit point derived from the track circuit by using the point "b" as a base point so that the wireless-control-compliant train 41*a* does not enter the section B where the track circuit has been dropped. Consequently, the stop limit point derived from the track circuit is set behind the stop limit point that should be generated, and is transmitted to the wireless-control-compliant train 41. Since the actual present position is past this set stop limit point, the wireless-control-compliant train 41 undesirably makes an emergency stop.

As described above, on the track 50 in which the wireless-control-compliant train 41 and the non-wireless-control-compliant train 42 coexist, the position of the non-wireless-control-compliant train 42 is identified using the track circuit, and the stop limit point of the wireless-control-compliant train 41 is determined. However, if a transmission delay occurs in the wireless train control system, the ground control device 10 erroneously recognizes the position of the wireless-control-compliant train 41, and the wireless-control-compliant train 41 makes an emergency stop due to the track circuit of the section B dropped by the wireless-control-compliant train 41 itself. That is, the occurrence of a transmission delay causes the following problem: the stop limit point of a train is updated by a track circuit dropped by the train itself, causing the train to make an emergency stop.

Figure 4:
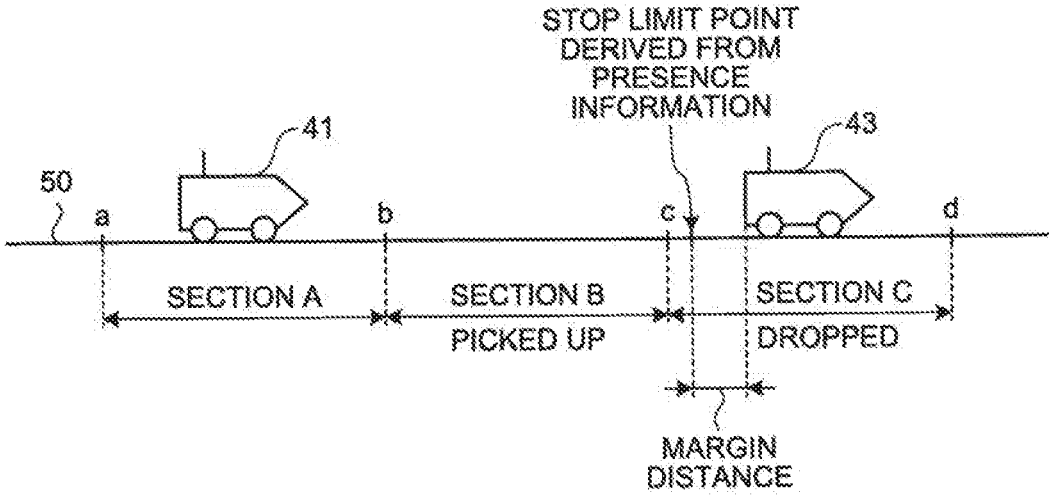
FIG. 4 is a diagram illustrating a stop limit point of the wireless-control-compliant train in the wireless train control system according to the embodiment.

FIG. 4 is a diagram illustrating a stop limit point of the wireless-control-compliant train 41 in the wireless train control system according to the present embodiment. In FIG. 4, the preceding train for the wireless-control-compliant train 41 is a wireless-control-compliant train 43, which means that both trains support wireless communication. In FIG. 4, the track circuit of the section C is dropped by the wireless-control-compliant train 43, and the track circuit of the section B is picked up. The ground control device 10 identifies the presence of the wireless-control-compliant train 43 in the section C, using the position information obtained through wireless communication. The stop limit point derived from the presence information is set for the wireless-control-compliant train 41, and this set stop limit point of the wireless-control-compliant train 41 is a position spaced a margin distance from the rearmost part of the wireless-control-compliant train 43. That is, the stop limit point derived from the presence information for the wireless-control-compliant train 41 exists in the section C, and the wireless-control-compliant train 41 can travel up to the stop limit point within the section C.

Figure 5:
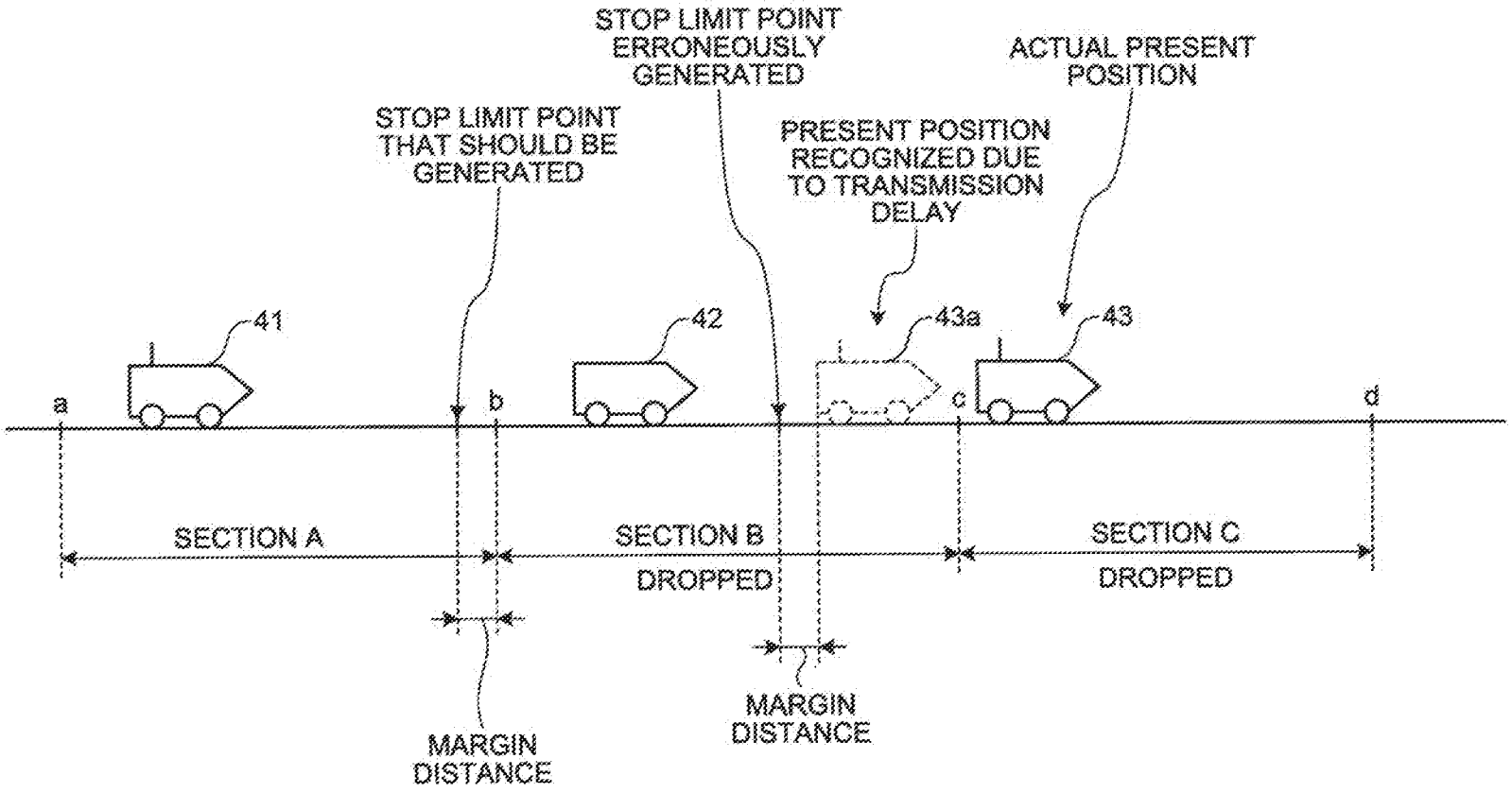
FIG. 5 is a diagram illustrating a stop limit point of the wireless-control-compliant train in the wireless train control system according to the embodiment.

FIG. 5 is a diagram illustrating a stop limit point of the wireless-control-compliant train 41 in the wireless train control system according to the present embodiment. In FIG. 5, the preceding train for the wireless-control-compliant train 41 is the non-wireless-control-compliant train 42, and the preceding train for the non-wireless-control-compliant train 42 is the wireless-control-compliant train 43. The wireless-control-compliant train 43 in FIG. 5 has just entered the section C across the point "c". The ground control device 10 identifies the position of the wireless-control-compliant train 43, using the position information obtained through wireless communication. If a transmission delay occurs, however, the ground control device 10 erroneously recognizes that the wireless-control-compliant train 43 exists at the position of a wireless-control-compliant train 43*a*.

The track circuit state information indicates that the section B including the non-wireless-control-compliant train 42 is dropped, but the ground control device 10 erroneously recognizes that the drop of the section B is caused by the wireless-control-compliant train 43*a*. Therefore, although the ground control device 10 should set the stop limit point of the wireless-control-compliant train 41 at a position spaced a margin distance from the point "b", which is the end of the track circuit of the section B, the ground control device 10 undesirably sets the stop limit point of the wireless-control-compliant train 41 at a position spaced a margin distance from the rearmost part of the wireless-control-compliant train 43*a*.

As described above, on the track 50 in which wireless-control-compliant trains and non-wireless-control-compliant trains coexist, the position of a wireless-control-compliant train is identified through wireless communication, the position of a non-wireless-control-compliant train is identified using the track circuit, and the stop limit point of the wireless-control-compliant train 41 is determined. However, if a transmission delay occurs in the wireless train control system, the stop limit point my be generated erroneously. That is, the occurrence of a transmission delay in the wireless train control system also causes the following problem: a stop limit point is updated while a non-wireless-control-compliant train is lost, and a stop limit point is erroneously generated ahead of the stop limit point that should be set.

Figure 6:
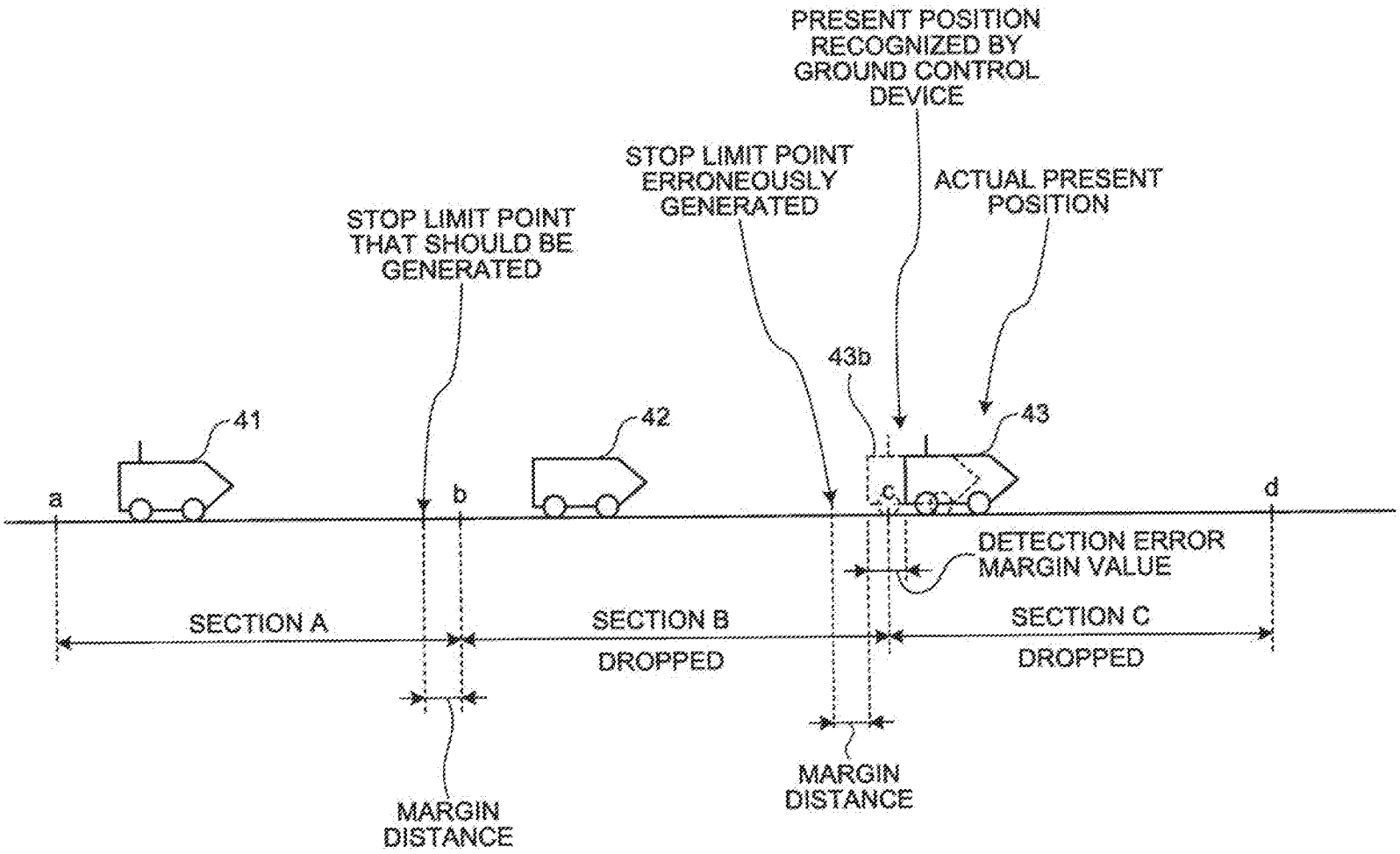
FIG. 6 is a diagram illustrating a stop limit point of the wireless-control-compliant train in the wireless train control system according to the embodiment.

FIG. 6 is a diagram illustrating a stop limit point of the wireless-control-compliant train 41 in the wireless train control system according to the present embodiment. In FIG. 6, the preceding train for the wireless-control-compliant train 41 is the non-wireless-control-compliant train 42, and the preceding train for the non-wireless-control-compliant train 42 is the wireless-control-compliant train 43. The wireless-control-compliant train 43 in FIG. 6 has just entered the section C across the point "c". As illustrated in FIG. 6, the position information on the wireless-control-compliant train 43 reflects a detection error margin value for safety added to the position actually detected by the train itself. FIG. 6 indicates that an erroneous stop limit point is generated due to the detection error margin value. The ground control device 10 identifies the position of the wireless-control-compliant train 43, using the position information obtained through wireless communication, but the ground control device 10 erroneously recognizes that the wireless-control-compliant train 43 exists at the position of a wireless-control-compliant train 43*b* due to the detection error margin value. Note that although the detection error margin value is a value determined by the system, some value may be further added to the determined detection error margin value according to the travel distance of a train.

The track circuit state information indicates that the section B including the non-wireless-control-compliant train 42 is dropped, but the ground control device 10 erroneously recognizes that the drop of the section B is caused by the wireless-control-compliant train 43*b*. Therefore, although the ground control device 10 should set the stop limit point of the wireless-control-complaint train 41 at a position spaced a margin distance from the point "b" which is the end of the track circuit of the section B, the ground control device 10 sets the stop limit point of the wireless-control-compliant train 41 at a position spaced a margin distance from the rearmost part of the wireless-control-compliant train 43*b*. In this way, a stop limit point may be generated at an erroneous position due to the detection error margin value.

Figure 7:
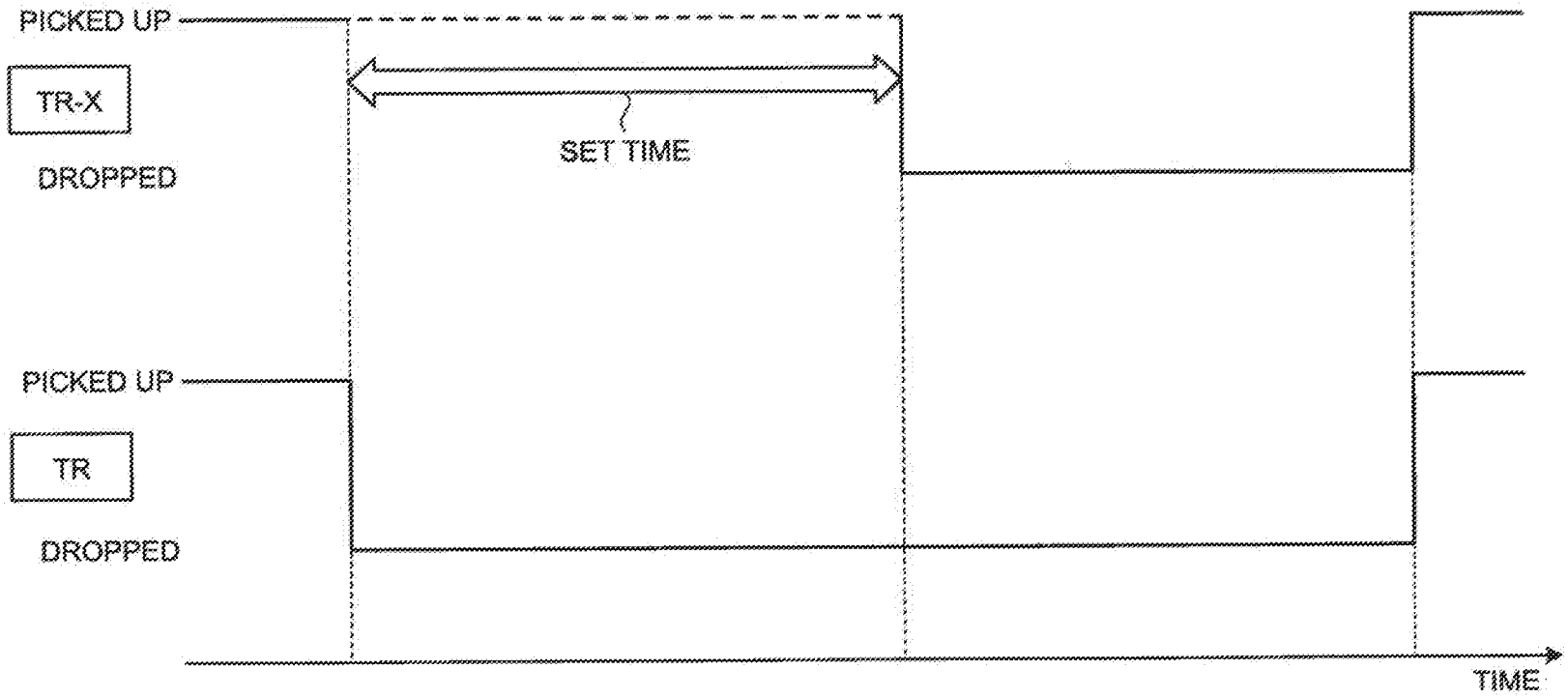
FIG. 7 is a diagram illustrating an example of a track circuit state signal TR and a time-triggered track circuit state signal TR-X according to the embodiment.

Therefore, the present embodiment uses a track circuit state signal TR that is information indicating that the track circuit is picked up or dropped and a time-triggered track circuit state signal TR-X that provides a time element for the track circuit state. FIG. 7 is a diagram illustrating an example of the track, circuit state signal TR and the time-triggered track circuit state signal TR-X according to the present embodiment. In FIG. 7, first, when the track circuit state signal TR is dropped, the counting of the time element of the time-triggered track circuit state signal TR-X is started. Then, when the counting of the time element of the time-triggered track circuit state signal TR-X reaches a set time, the time-triggered track circuit state signal TR-X is dropped. Here, the set time, which depends on the specifications of the wireless train control system, is the maximum transmission delay time in acquiring the position information on the wireless-control-compliant train 41 by the ground control device 10. It should be noted that the timing at which the time-triggered track circuit state signal TR-X is picked up may be the same as the timing at which the track circuit state signal TR is picked up. The time-triggered track circuit state signal TR-X is managed by the ground control device 10. However, since the time-triggered track circuit state signal TR-X is paired with the track circuit state signal TR, the time-triggered track circuit state signal TR-X may be managed by the track circuit state information acquisition device 52 and transmitted to the ground control device 10.

In a case where the time-triggered track circuit state signal TR-X is introduced as illustrated in FIG. 7, the time-triggered track circuit state signal TR-X remains in a picked-up state from the time immediately after the entry of the wireless-control-compliant train 41 into the section B as illustrated in FIG. 3 until the end of the set time, during which the track circuit state signal TR is dropped. In this way, in a case where the condition for referring to the time-triggered track circuit state signal TR-X is satisfied, where the track circuit state signal TR is dropped, and where the time-triggered track circuit state signal TR-X is picked up, the stop limit point of a train is not updated by determining that the drop of the track circuit state signal TR is caused by the train itself. The present embodiment, which prevents the stop limit point of the train from being updated by a track circuit dropped by the train itself, makes it possible to prevent a train from making an emergency stop. It is to be noted that the time-triggered track circuit state signal TR-X needs to be referred to only when the ground control device 10 generates the time-triggered track circuit state signal TR-X for the wireless-control-compliant train 41 and the track circuit state signal TR is dropped before the last stop limit point. Whether the track circuit state signal TR is dropped before the last stop limit point can be determined simply by referring to a line information database held by the ground control device 10, converting the order or position information on the blocks and track circuits in the route to kilometers, and comparing the magnitudes thereof.

Figure 8:
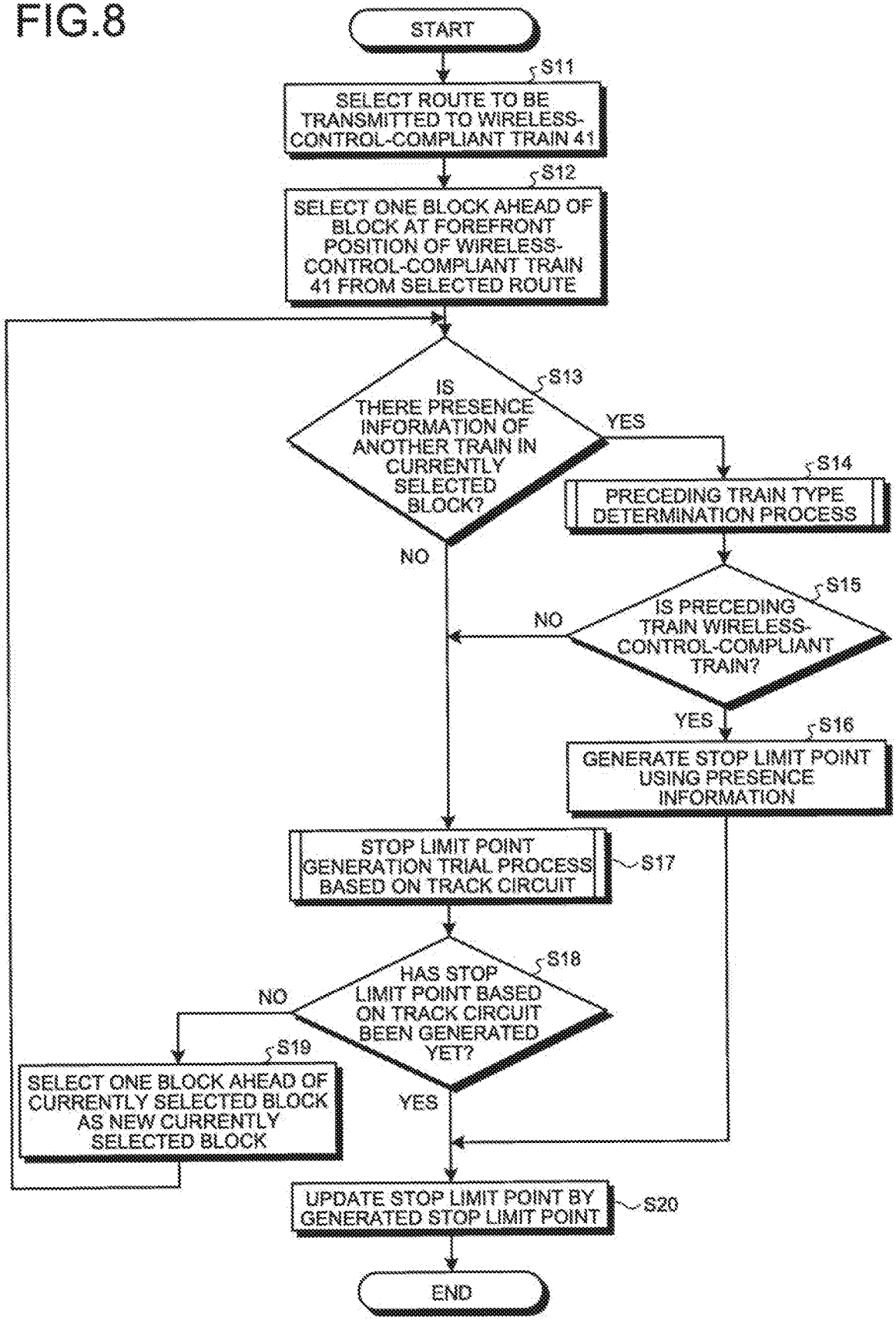
FIG. 8 is a flowchart illustrating an example of how a train control unit of a ground control device in the wireless train control system according to the embodiment generates and updates a stop limit point.

FIG. 8 is a flowchart illustrating an example of how the train control unit 11 of the ground control device 10 in the wireless train control system according to the present embodiment generates and updates a stop limit point. Note that blocks that are referred to in the explanation of FIG. 8 are sections into which the track is finely divided, and each section illustrated in FIG. 1 includes a plurality of blocks. First, the train control unit 11 selects a route to be transmitted to the wireless-control-compliant train 41 (S11). At this time, the routs end, i.e., the farthest block end in the traveling direction is used as a base point to set a stop limit point. Next, the train control unit 11 selects one block ahead of the block including the forefront position of the wireless-control-compliant train 41 from the route selected in S11 (S12). That is, the train control unit 11 selects the block which the wireless-control-compliant train 41 enters next. Hereinafter, the block selected in this step is described as a currently selected block.

Next, the train control unit 11 determines whether there is presence information on another train in the currently selected block (S13). Here, the presence information is information indicating the presence of a wireless-control-compliant train in the wireless train control system. That is, it is determined in S13 whether another wireless-control-compliant train is present in the currently selected block. If there is presence information on another train in the currently selected block (S13: Yes), another wireless-control-compliant train is present in the block. Therefore, the train control unit 11 performs a preceding train type determination process (S14) to determine whether the preceding train is a wireless control-compliant train (S15). The sub-process of S14 will be described later. If the preceding train is a wireless control-compliant train (S15: Yes), a stop limit point is generated using this presence information (S16), the stop limit point is updated by the generated stop limit point (S20), and the process is finished. If there is no presence information on another train in the currently selected block (S13: No) or if the preceding train is not a wireless-control-compliant train (S15: No), the train control unit 11 performs a stop limit point generation trial process based on the track circuit (S17). The sub-process of S17 will be described later.

Next, the train control unit 11 determines whether a stop limit point based on the track circuit has already been generated (S18). In other words, it is determined whether a stop limit point based on the track circuit has been generated in step S17. If a stop limit point based on the track circuit has already been generated (S18: Yes), the train control unit 11 updates the stop limit point with the generated stop limit point (S20), and finishes the process. If a stop limit point based on the track circuit has not been generated (S18: No), the train control unit 11 selects one block ahead of the currently selected block as a new currently selected block, and returns to S13 (S19). After that, step S13 and the subsequent steps are performed on the block selected as the currently selected block in S19. Note that if checks on all the blocks in the selected route have been finished with no stop limit point generated using either the presence information or the track circuit, the position initially set in S11 using the route end as the base point is set as the stop limit point.

Figure 9:
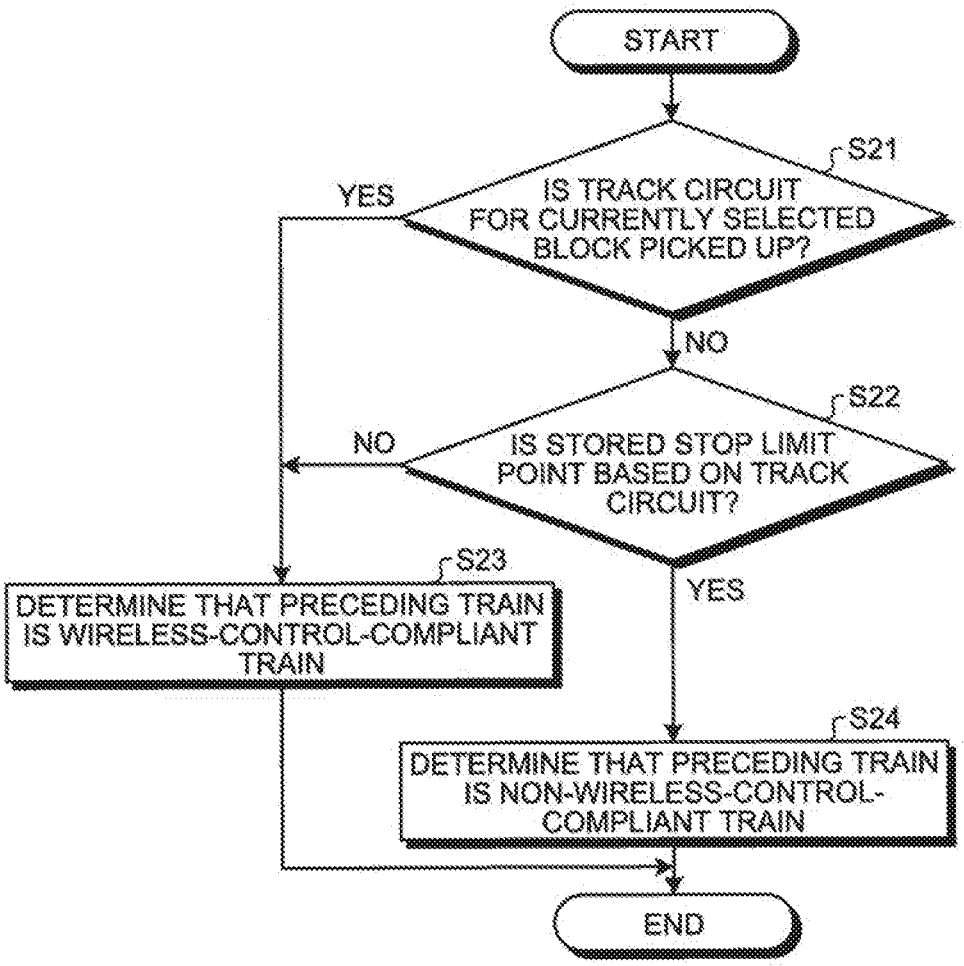
FIG. 9 is a flowchart illustrating an example of a sub-process performed in S14 of FIG. 8.

FIG. 9 is a flowchart illustrating an example of the sub-process performed in S14 of FIG. 8. First, it is determined whether the track circuit for the currently selected block is picked up (S21). If the track circuit for the currently selected block is not picked up (S21: No), that is, if the track circuit for the currently selected block is dropped, it is determined whether the stored stop limit point is based on the track circuit, that is, the type of the stop limit point is determined (S22). If the stored stop limit point is based on the track circuit (S22: Yes), it is determined that the preceding train is a non-wireless-control-compliant train (S24), and the process is finished. If the track circuit for the currently selected block is picked up (S21: Yes) or if the track circuit for the currently selected block is not picked up and the stored stop limit point is not based on the track circuit (S22: No), it is determined that the preceding train is a wireless-control-compliant train (S23), and the process is finished.

Figure 10:
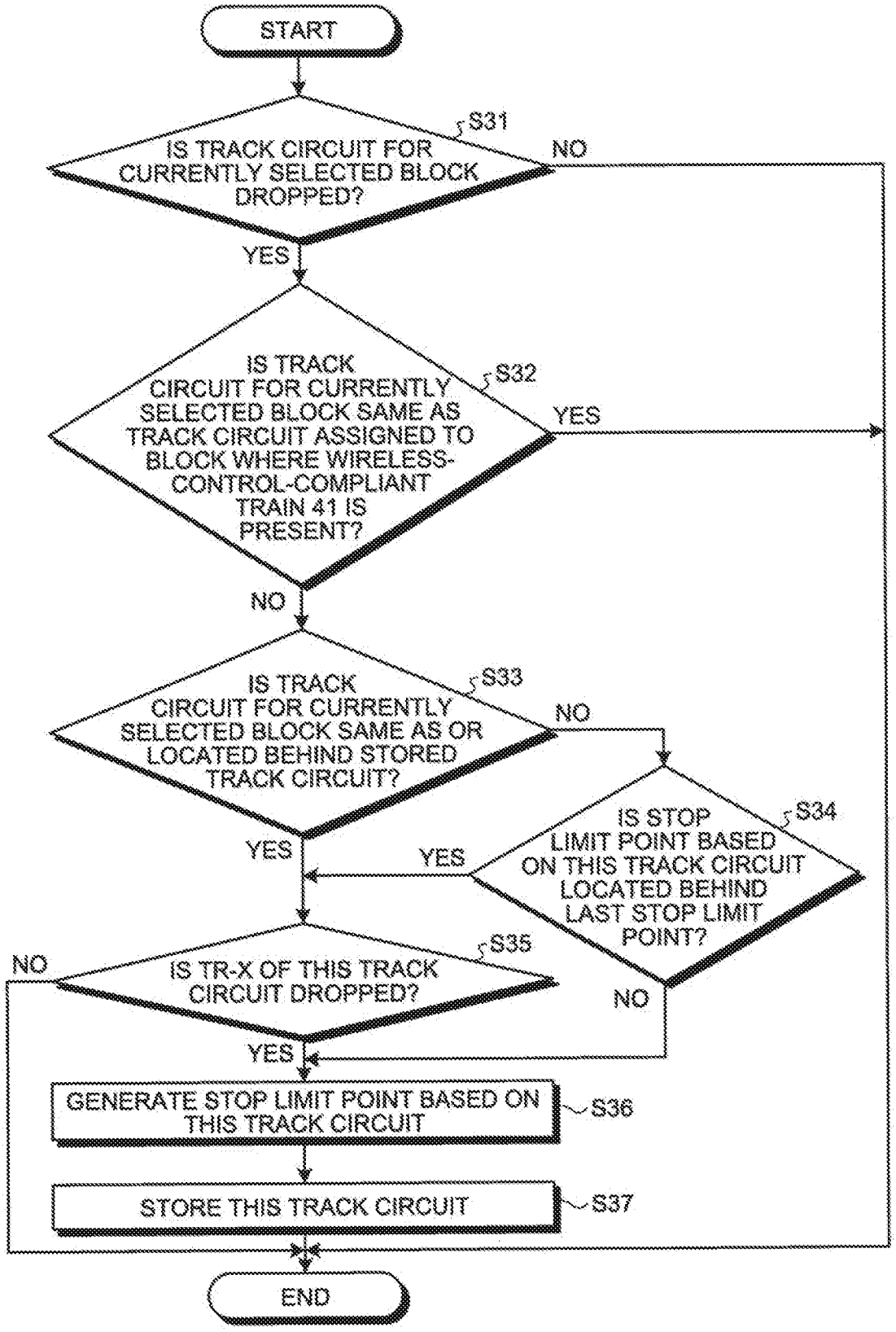
FIG. 10 is a flowchart illustrating an example of a sub-process performed in S17 of FIG. 8.

FIG. 10 is a flowchart illustrating an example of the sub-process performed in S17 of FIG. 8. First, it is determined whether the track circuit for the currently selected block is dropped (S31). If the track circuit for the currently selected block is not dropped (S31: No), that is, if the track circuit for the currently selected block is picked up, no train is present in this block. Therefore, the process is finished without generating a stop limit point.

If the track circuit for the currently selected block is dropped (S31: Yes), it is determined whether the track circuit for the currently selected block is the same as the track circuit assigned to the block where the wireless-control-compliant train 41 is present (S32). If the track circuit for the currently selected block is the same as the track circuit assigned to the block where the wireless-control-compliant train 41 is present (S32: Yes), the process is finished without generating a stop limit point. This is because the currently selected block is not suitable as a block for generating a stop limit point as described below.

Figure 11:
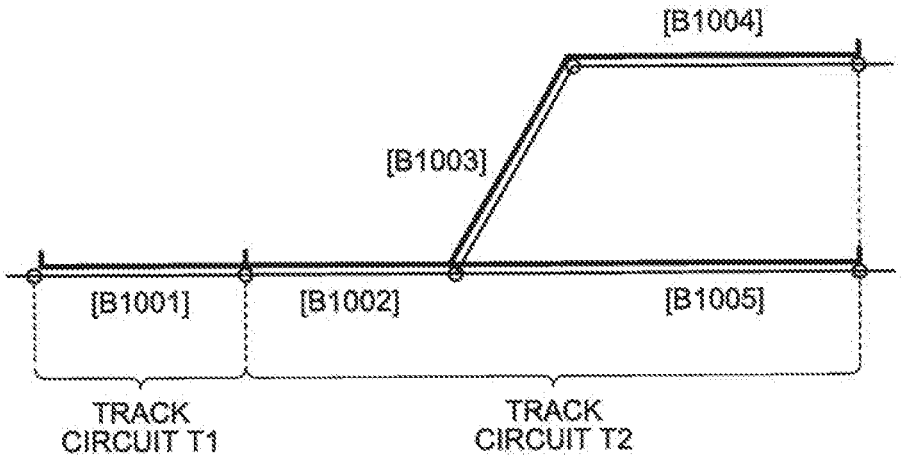
FIG. 11 is a diagram illustrating an exemplary relationship between block numbers around a branch point and track circuits according to the embodiment.

FIG. 11 is a diagram illustrating an exemplary relationship between block numbers around a branch point and track circuits according to the present embodiment. In FIG. II, the track divided into block numbers [B1001], [B1002], [B1003], [B1004], and [B1005] is illustrated. A track circuit T1 is provided for the block number [B1001], and a track circuit T2 is provided for the block numbers [B1002], [B1003], [B1004], and [B1005]. The track illustrated in FIG. 11 branches into a route entering [B1003] through [B1002] and a route entering [B1005], through [B1002]. In this way, one track circuit may be assigned over a plurality of blocks. Only one train is allowed to be present in a track circuit including branches. In this case, therefore, when a train is present in the section represented by the block number [B1002] and the track circuit T2 is dropped, it can be understood that the track circuit T2 is occupied by the train itself. Therefore, as described above, if the track circuit for the currently selected block is the same as the track circuit assigned to the block where the wireless-control-compliant train 41 is present (S32: Yes), the process is finished without generating a stop limit point. Note that the correspondence relationship between blocks and track circuits is stored in the line information database held by the ground control device 10.

If the track circuit for the currently selected block is not the same as the track circuit assigned to the block where the wireless-control-compliant train 41 is present (S32: No), it is determined whether the track circuit assigned to the currently selected block is the same as the track circuit stored as having been used for generating the stop limit point or is located behind the stored track circuit (S33). If the track circuit assigned to the currently selected block is the same as the track circuit stored as having been used for generating the stop limit point or is located behind the stored track circuit (S33: Yes), the process proceeds to S35. If the track circuit assigned to the currently selected block is not the same as the track circuit stored as having been used for generating the stop limit point and is not located behind the stored track circuit (S33: No) a stop limit point is temporarily generated using the end of this track circuit as a base point, and it is determined whether this stop limit point is located behind the last stop limit point (S34). Note that when the wireless-control-compliant train 41 generates a stop limit point for the first time, there is no track circuit stored as having been used for generating the stop limit point. In this case, therefore, it is determined that the track circuit assigned to the currently selected block is not the same as the track circuit stored as having been used for generating the stop limit point (S33: No), and the process proceeds to S34. Similarly, the absence of a preceding train means that there is no track circuit stored as having been used for generating the stop limit point. In this case, therefore, it is determined that the track circuit assigned to the currently selected block is not the same as the stored track circuit (S33: No).

In a case where the stop limit point temporarily generated using the end of this track circuit as the base point is located behind the last stop limit point (S34: Yes), there is a possibility that the drop of the track circuit state signal TR is due to the train itself; therefore, the process proceeds to S35. Then, it is determined whether the time-triggered track circuit state signal TR-X of this track circuit is dropped (S35). In S35, if the time-triggered track circuit state signal TR-X is picked up, it is determined that the drop of the track circuit state signal TR is due to the train itself, and if the time-triggered track circuit state signal TR-X is dropped, it is determined that the drop of the track circuit state signal TR is due to another train, not the train itself. If the time-triggered track circuit, state signal TR-X is not dropped (S35: No), the drop of the track circuit state signal TR is due to the train itself; therefore, the process is finished without updating the stop limit point. If the time-triggered track circuit state signal TR-X is dropped (S35: Yes), a stop limit point based on this track circuit is generated (S36), and this track circuit is stored as having been used for generating the stop limit point, that is, the storage of generation of the stop limit point is updated by this track circuit (S37). The process is thus finished. In S34, if the stop limit point temporarily generated using the end of this track circuit assigned to the currently selected block as the base point is not located behind the last stop limit point (S34: No), a stop limit point based on this track circuit is generated (S36), that is, the stop limit point temporarily generated in S34 is employed as the stop limit point. Then, this track circuit is stored as having been used for generating the stop limit point, that is, the storage of generation of the stop limit point is updated by this track circuit (S37). The process is thus finished. If the last stop limit point does not exist, the process branches to No in S34. Then, a stop limit point based on this track circuit is generated (S36), and this track circuit is stored as having been used for generating the stop limit point, that is, the storage of generation of the stop limit point is updated by this track circuit (S37). The process is thus finished.

As described above, according to the present embodiment, it is possible to prevent a train from making an emergency stop due to the stop limit point erroneously set based on the train itself, and to prevent a stop limit point from being set while a non-wireless-control-compliant train is lost. Therefore, it is possible to prevent a wireless-control-compliant train from generating an incorrect stop limit point and to obtain a wireless train control system capable of stable operation. In addition, by preventing a wireless-control-compliant train from making an unintentional emergency stop, the occurrence of power consumption due to the emergency stop and restoration therefrom can be prevented, leading to low power consumption.

Figure 12:
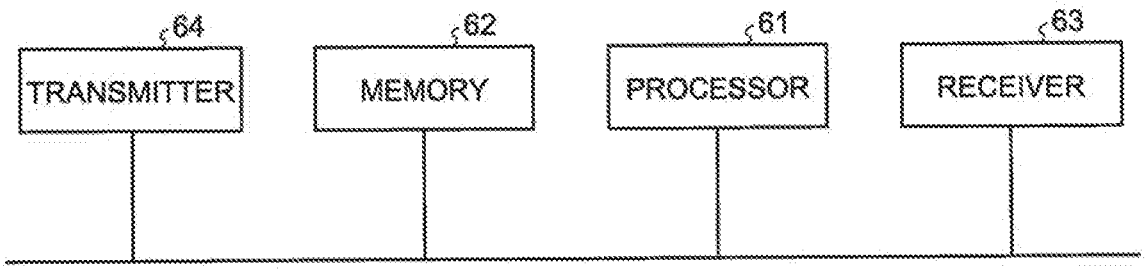
FIG. 12 is a diagram illustrating an exemplary general configuration of hardware for implementing the ground control device according to the embodiment.

In the above-described present embodiment, the ground control device 10 at least includes a processor, a memory, a receiver, and a transmitter, and the operation of each device can be implemented by software. FIG. 12 is a diagram illustrating an exemplary general configuration of hardware for implementing the ground control device 10 of the wireless train control system according to the present embodiment. The device illustrated in FIG. 12 includes a processor 61, a memory 62, a receiver 63, and a transmitter 64. The processor 61 performs computation and control with the aid of software using input data. The memory 62 stores the input data or data and software required for the processor 61 to perform computation and control. The receiver 63 is an interface corresponding to the position information reception unit 12 and the track circuit state information reception unit 14 for receiving position information and track circuit state information. The transmitter 64 is an interface corresponding to the control information transmission unit 13 for transmitting control information. It is to be noted that a plurality of processors 61, memories 62, receivers 63, and transmitters 64 may be provided.

The above explanation is based on the assumption that the non-wireless-control-compliant train 42 that is the preceding train does not move backward. If the ground control device 10 recognizes that the non-wireless-control-compliant train 42 that is the preceding train has moved backward, the ground control device 10 instantaneously drops the time-triggered track circuit state signal TR-X. The ground control device 10 monitors track circuit state information to determine whether the track circuit is improperly dropped or picked up. As an example, in a case where the traveling direction on the track 50 is determined by the system, if a track circuit in the direction opposite to the permitted traveling direction is suddenly dropped, it is determined that the drop of the track circuit is an improper drop. In this way, the backward movement of a non-wireless-control-compliant train that is a preceding train can be recognized by detection of an improper drop of track circuit state information. In addition, if the ground control device 10 determines that a track circuit dropped due to the failure of the track circuit is an improper drop, the ground control device 10 instantaneously drops the time-triggered track circuit state signal TR-X. Note that the track circuit state information acquisition device 52 may monitor track circuit state information and manage the time track circuit state signal TR-X.

In the present embodiment, when the ground control device 10 is started up, the time-triggered track circuit state signal TR-X is set to a drop state to prevent entry into an area where other trains are likely to be present. In a case where the time-triggered track circuit state signal TR-X is managed by the track circuit state information acquisition device 52, the time-triggered track circuit state signal TR-X only needs to be set to a drop state for starting up the track circuit state information acquisition device 52.

Note that the present invention is not limited to the wireless train control system, and the wireless train control method and the ground control device described in the present embodiment are also included in the present invention.

The configuration described in the above-mentioned embodiment indicates an example of the contents of the present invention. The configuration can be combined with another well-known technique, and a part of the configuration can be omitted or changed in a range not departing from the gist of the present invention.

REFERENCE SIGNS LIST

10 ground control device; 11 train control unit; 12 position information reception unit; 13 control information transmission unit; 14 track circuit state information reception unit; 20 network; 31, 32 wireless base station; 41, 41*a*, 43, 43*a*, 43*b* wireless-control-compliant train; 42 non-wireless-control-compliant train; 50 track; 51A, 51B, 51C relay; 52 track circuit state information acquisition device; 61 processor; 62 memory; 63 receiver; 64 transmitter.

The invention claimed is:

1. A wireless train control system to control, by a track circuit state information obtainer and a ground controller, a wireless-control-compliant train on a track in which one or more wireless-control-compliant trains and one or more non-wireless-control-compliant trains coexist, the wireless train control system comprising:

the track circuit state information obtainer to generate a track circuit state signal and a time-triggered track circuit state signal, the track circuit state signal indicating whether a track circuit of the track is picked up or dropped, the time-triggered track circuit state signal indicating a drop of the track circuit at a timing delayed by a set time after the track circuit state signal indicates that the track circuit is dropped; and the ground controller to generate a stop limit point of the wireless-control-compliant train by using presence information if a preceding train for the wireless-control-compliant train is another wireless-control-compliant train, and generate the stop limit point of the wireless-control-compliant train by using the track circuit state signal and the time-triggered track circuit state signal if the preceding train for the wireless-control-compliant train is the non-wireless-control-compliant train.

2. The wireless train control system according to claim 1, wherein the ground controller does not update the stop limit point if the track circuit state signal indicates that the track circuit is dropped while the time-triggered track circuit state signal indicates that the track circuit is picked up, and updates the stop limit point if the track circuit state signal indicates that the track circuit is dropped while the time-triggered track circuit state signal indicates that the track circuit is dropped.

3. The wireless train control system according to claim 1, wherein the set time is a maximum transmission delay time in acquiring position information on the wireless-control-compliant train by the ground controller.

4. The wireless train control system according to claim 1, wherein the track circuit state information obtainer drops the time-triggered track circuit state signal in response to detecting an improper drop of the track circuit.

5. The wireless train control system according to claim 1, wherein the ground controller determines whether the preceding train is the wireless-control-compliant train or the non-wireless-control-compliant train on a basis of the presence information, the track circuit state signal, and a type of the stop limit point stored.

6. A ground control device to control a wireless-control-compliant train on a track in which one or more wireless-control-compliant trains and one or more non-wireless-control-compliant trains coexist, the ground control device comprising:

a position information receiver to receive presence information on the wireless-control-compliant train;

a track circuit state information receiver to receive track circuit state information of the track;

a train controller to generate control information including a stop limit point of the wireless-control-compliant train, by using the presence information and the track circuit state information; and a control information transmitter to transmit the control information to the wireless-control-compliant train, wherein the train controller:

generates the stop limit point by using the presence information if a preceding train for the wireless-control-compliant train is another wireless-control-compliant train;

generates the stop limit point by using the track circuit state information if the preceding train is the non-wireless-control-compliant train; and uses a track circuit state signal, indicating whether the track circuit is picked up or dropped, and a time-triggered track circuit state signal, indicating a drop of the track circuit at a timing delayed by a set time after the track circuit state signal indicates that the track circuit is dropped, to update the stop limit point.

7. The ground control device according to claim 6, wherein the train controller does not update the stop limit point if the track circuit state signal indicates that the track circuit is dropped while the time-triggered track circuit state signal indicates that the track circuit is picked up, and updates the stop limit point if the track circuit state signal indicates that the track circuit is dropped while the time-triggered track circuit state signal indicates that the track circuit is dropped, wherein the track circuit state signal and the time-triggered track circuit state signal are included in the track circuit state information.

8. The ground control device according to claim 7, wherein the set time is a maximum transmission delay time in acquiring position information on the wireless-control-compliant train.

9. The ground control device according to claim 7, wherein the train controller manages the time-triggered track circuit state signal.

10. A wireless train control method for controlling a wireless-control-compliant train on a track in which one or more wireless-control-compliant trains and one or more non-wireless-control-compliant trains coexist, the method comprising:

generating a track circuit state signal and a time-triggered track circuit state signal, the track circuit state signal indicating whether a track circuit of the track is picked up or dropped, the time-triggered track circuit state signal indicating a drop of the track circuit at a timing delayed by a set time after the track circuit state signal indicates that the track circuit is dropped;

generating a stop limit point of the wireless-control-compliant train by using presence information if a preceding train for the wireless-control-compliant train is another wireless-control-compliant train; and generating the stop limit point of the wireless-control-compliant train by using the track circuit state signal and the time-triggered track circuit state signal if the preceding train for the wireless-control-compliant train is the non-wireless-control-compliant train.

11. The wireless train control method according to claim 10, wherein if the track circuit state signal indicates that the track circuit is dropped while the time-triggered track circuit state signal indicates that the track circuit is picked up, the stop limit point is not updated, and if the track circuit state signal indicates that the track circuit is dropped while the time-triggered track circuit state signal indicates that the track circuit is dropped, the stop limit point is updated.

* * * * *